United States Patent [19]

Pinnow et al.

[11] Patent Number: 4,575,164

[45] Date of Patent: Mar. 11, 1986

[54] HEAVY DUTY UNIVERSAL ADJUSTABLE SLIDER FOR FOOD SERVICE CART

[75] Inventors: Curtis C. Pinnow; Robert L. Logemann, both of Mundelein, Ill.

[73] Assignee: Carter-Hoffman Corporation, Mundelein, Ill.

[21] Appl. No.: 612,061

[22] Filed: May 18, 1984

[51] Int. Cl.[4] ..... A47F 3/14

[52] U.S. Cl. ..... 312/350; 108/109; 248/243; 211/126

[58] Field of Search ..... 312/350; 108/97, 98, 108/109; 211/186, 187, 208, 106, 107, 108; 248/243, 242, 248, 250, DIG. 12

[56] References Cited

U.S. PATENT DOCUMENTS

| | | | |
|---|---|---|---|
| 2,691,502 | 10/1954 | Jones | 248/243 |
| 3,097,746 | 7/1963 | Handler et al. | 211/126 |
| 3,199,683 | 8/1965 | Graswich | 248/243 X |
| 3,655,063 | 4/1972 | Landry | 211/126 |

FOREIGN PATENT DOCUMENTS

| | | | |
|---|---|---|---|
| 2801773 | 4/1979 | Fed. Rep. of Germany | 248/243 |
| 2513351 | 3/1983 | France | 248/243 |

*Primary Examiner*—William E. Lyddane
*Assistant Examiner*—Joseph Falk
*Attorney, Agent, or Firm*—Wood, Dalton, Phillips, Mason & Rowe

[57] ABSTRACT

According to the invention, a universal-type slider is provided for adjustable engagement with spaced, slotted uprights associated with a food service cart. Each slider is preferably formed from a single blank of relatively thin gauge bendable material. The blank is preformed with a substantially rectangular body having a mounting tab and gusset plate extending lengthwise beyond each opposite end of the body. The blank is folded in stepwise fashion to define two shelves. The gussets and tabs are respectively folded to reinforce the shelves and provide mounting elements for the sliders.

7 Claims, 5 Drawing Figures

HEAVY DUTY UNIVERSAL ADJUSTABLE SLIDER FOR FOOD SERVICE CART

BACKGROUND OF THE INVENTION

1. Field of the Invention

This invention relates to food service carts and, more particularly, to adjustable slides for accepting food trays or pans.

2. Background Art

Food preparation operations catering to large volume clients such as hotels, restaurants, hospitals and the like, generally use stainless steel food service carts. The carts are wheel equipped and insulated to maintain conditions in the food storage space to preserve the warm or cold state of the food between the time of loading in the food preparation area and the time of delivery to the ultimate consumer.

Normally, these carts are provided with internal upright structural columns which carry horizontal supports called slides or sliders, which accept and support trays or pans upon which the food is placed. After being filled, the cart doors are closed and sealed and the carts loaded upon trucks for delivery to the consumer. At the point of destination the carts are unloaded and wheeled to a convenient point for distribution of the contents.

Several serious problems have occurred with such operations which, to date, have not been adequately dealt with by prior art designers. During handling, the filled carts may tip or be jostled which oft times causes the slides to dislodge, dumping the food contents into adjacent pans or the bottom of the cart. Permanent mounting of the slides to prevent dislodging precludes adjustability of the sliders which seriously compromises the versatility of the carts to carry the usually employed different sizes of food trays.

Another drawback with the prior structures is that the slider mounting elements are prone to failure under the substantial weight of the filled pans and trays. A typical mounting structure for each slider uses two tabs struck directly from the material of the slider, each tab opening and being directed transversely from the other. Preferably one of the tabs is extendable horizontally into a slot in one of the uprights and upon being fully seated situates a downwardly opening tab in alignment with a slot into which it can be dropped. If either tab breaks or dislodges, the entire slide fails. If vibration raises the downwardly open tab sufficiently to clear its upright slot, the entire slider may become dislodged.

Another serious deficiency in the art is in the area of the slide type termed "universal" in the field. The universal slide normally defines a two shelf support, with each shelf capable of accommodating different width trays or pans. Heretofore, each universal type slider has been suspended from the uprights in cantilever-type fashion. To avoid unwanted flexing of the free end as might release the trays, the entire slider has generally been formed from a heavy gauge material. The use of a heavy material undesirably adds to the weight of the cabinet, complicates handling and increases the cost of manufacturing. Alternatively, braces might be bolted, welded, or otherwise secured to reinforce the slide shelves, additionally adding to weight and cost undesirably.

The present invention is specifically directed to overcoming one or more of the problems in the prior art structures that are enumerated above.

SUMMARY OF THE INVENTION

According to the invention, a universal slider is provided for engagement with spaced, slotted uprights or columns mounted within a food service cart. Each slider is preferably formed from a single blank of relatively thin gauge bendable material. The blank is preformed with a substantially rectangular body having a mounting tab and gusset plate extending lengthwise beyond each opposite end of the body.

The body is bent about a series of lengthwise, parallel fold lines to define a flat face for engagement with a vertical column wall of the cart and a first horizontal shelf offset from and continued into a second, lower shelf, which terminates at the free end of the slider. A mounting tab is bent at a right angle to the plane of the vertical face at each end of the body. To reinforce the shelves, the gusset at each end of the body is folded under the first shelf and bears between the column wall of the cart and the offset between shelves, providing a positive deterent to collapse of the outermost shelf of the slider under influence of a loaded food tray supported upon that shelf.

The principal objective of the invention is to provide a universal-type slider that is rugged yet which can be simply formed from a single blank of thin material without the provision of separate reinforcing elements or the performance of separate welding steps.

It is another aspect of the invention to provide a mounting tab that cooperates with the remainder of the slider structure to positively locate the slider on the cart yet permit manual repositioning of the same within the cart to properly accept food trays, pans and racks of differing size and configuration.

To accomplish the foregoing, the mounting tab comprises an elongate body spaced from the rectangular blank body by a stem which makes a T-shape with the tab body. A leading edge of each tab is directed into a slot in a cart upright and advanced upwardly sufficiently to present the trailing edge of the tab at the bottom of the slot. The entire slider is then pivoted toward the upright and dropped down to capture the wall of the upright between the vertical face of the slider and a facing edge of the tab body.

Accordingly, horizontal shifting of the slider is prohibited without vertically shifting the slider relative to the mounting upright to disengage the tabs. The weight of the food on the sliders prevents this vertical shifting as well as preventing disengagement of the slider from the column under vibrational movement of the slider in an up and down direction.

A further object is to provide a slider both universal in use, and easily installed and removed for cleaning as well as being readily formable from materials preferred for use in food handling equipment.

DETAILED DESCRIPTION OF THE DRAWINGS

Figure 1:
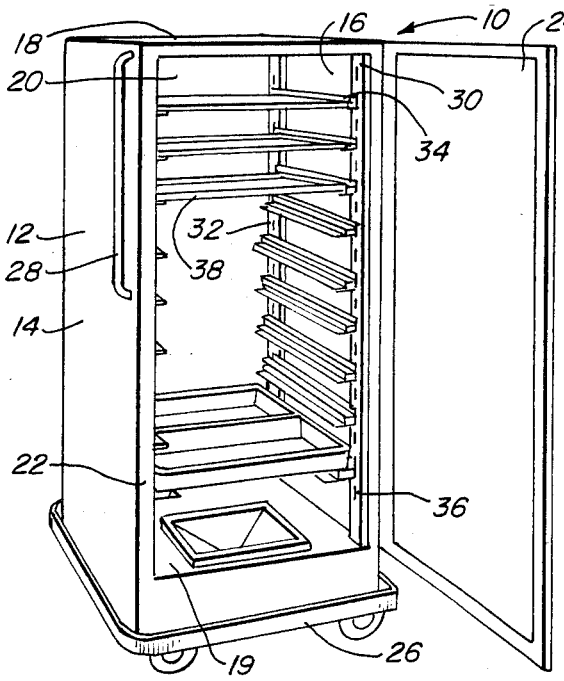
FIG. 1 is a front perspective view of an open food service cart incorporating tray bearing sliders according to the present invention.

A food service cart, to which the present invention is adaptable, is illustrated in FIG. 1 at 10. The cart 10 comprises a cubical cabinet 12 defined by side walls 14, 16, top wall 18, bottom wall 19 and rear wall 20. The open front edge 22 of the cabinet 12 is sealed by a hinged door 24. The walls 14, 16, 18, 19, 20 and door 24 are preferably made from stainless steel and insulated to maintain conditions within the cabinet consistent with the preservation of food stored in the cabinet 12.

The cabinet is mobilized by providing a wheeled platform 26. Handling of the cart is facilitated by mounting a handle 28 on at least one of the side walls 14, 16.

The cabinet is framed internally. The frame includes uprights or columns 30, 32 at the front and rear, of the cabinet, respectively for accepting the tray supporting sliders 34. Vertically spaced slots 36 are provided in each of the uprights at corresponding heights on the four uprights 30, 32. The sliders 34 on opposite side walls 14, 16 are mirror images of each other and located at the same height to maintain the trays 38 carrying the food horizontally, levelly situated.

Figure 3:
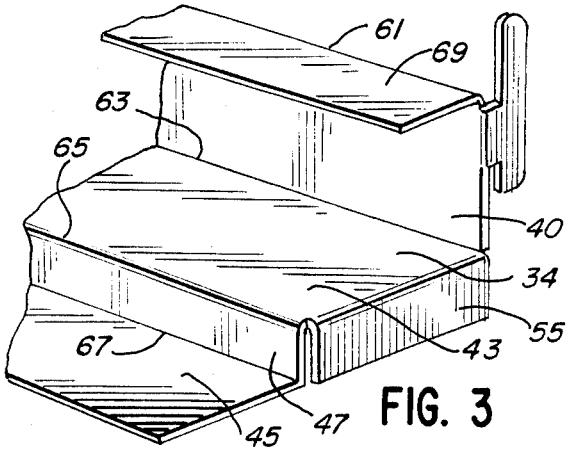
FIG. 3 is an enlarged, fragmentary perspective view of one end of the sliders formed from the blank of FIG. 2.
Figure 5:
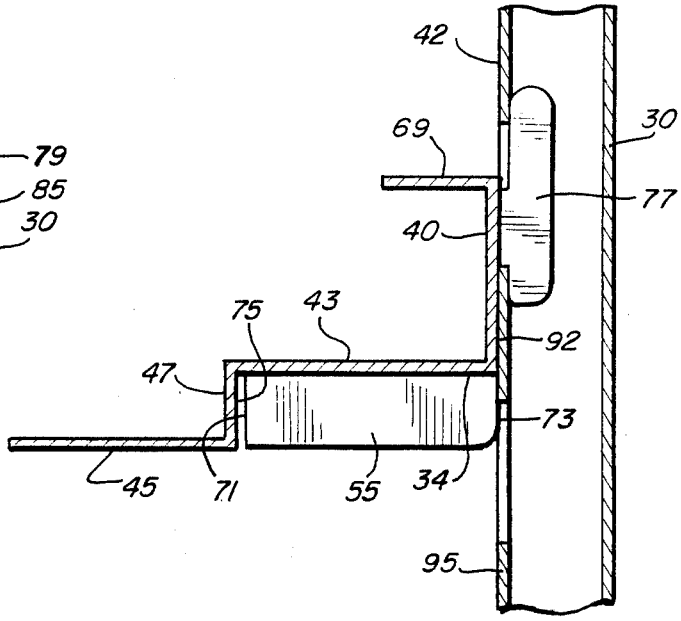
FIG. 5 is a fragmentary, sectional view of one of the sliders fully seated in the mounting upright.

FIGS. 3 and 5 best illustrate the construction of the universal slider. The slider 34 comprises a vertical wall 40 which bears facially against the adjacent wall surface 42 of the uprights 30, 32. Beneath the wall 40 is a first horizontal shelf 43 and a second, lower, horizontal shelf 45 connected by a vertical panel 47.

Food pans and trays are generally rectangular. The supporting area of the shelves is such that a flange on the pan or tray may rest upon one set of shelves or the other with sufficient looseness to allow the pan or tray to be manually pushed into the cart by sliding the flange over the supporting shelves. The upright surfaces 40 or 47 serve to retain the food pan or tray against excessive movement once inserted in the cart. A tray or pan of narrower width can be confined on the second shelves, whereas it would otherwise shift freely and undesirably between the cabinet side walls 14, 16 on the first shelves 43.

Figure 2:
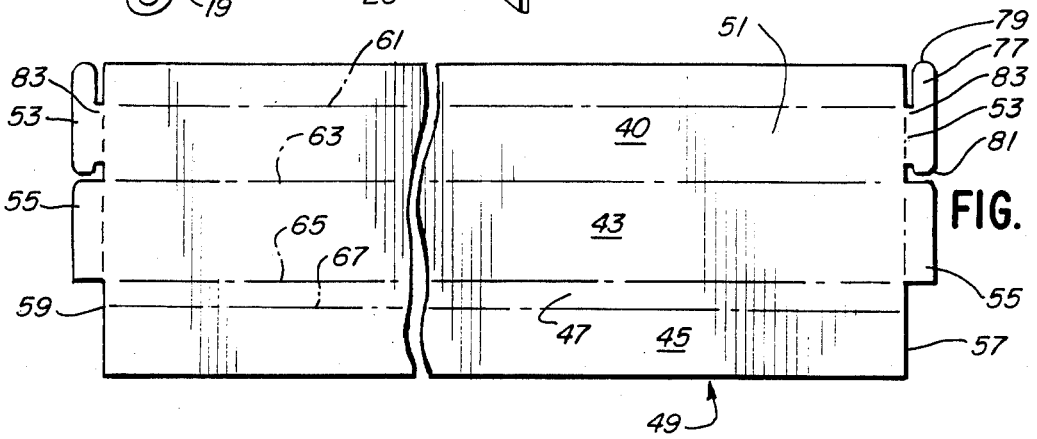
FIG. 2 is a plan view of a blank used to form each of the sliders.

To form the sliders 34 according to the present invention, a blank, as depicted in FIG. 2 at 49, is cut from a stainless steel sheet on the order of 16 gauge thickness. The blank 49 comprises a substantially rectangular body 51 with mounting tabs 53 and gussets 55 extending lengthwise beyond the ends 57, 59 of the body 51. First, second, third and fourth fold lines are indicated by dotted lengthwise lines on the blank and respectively designated 61, 63, 65, 67.

The vertical wall 40 is defined between the first and second fold lines; the first shelf 43 between the second and third lines; the panel 47 between the third and fourth lines; and the second shelf 45 beyond the fourth line. The blank is folded about the first, second, third and fourth fold lines in stepwise fashion to arrive at the FIG. 3 configuration for the body 51. An upper reinforcing flange 69 is folded about the first line 61 into parallel relationship with the first shelf 43. The flange 69 reinforces the wall 40 against deflection from a load applied to the shelves as well as providing a shelf for large food tray receipt, if desired.

The gussets 55 comprise an extension of the first shelf beyond the ends 57, 59. The degree of extension lengthwise of the body 51 beyond the ends 57, 59, which represents the length of the gusset on the formed slider, is a matter of choice. Preferably, to maximize support and minimize the amount of material, the gusset height is equal to the width of the panel 47 between the third and fourth fold lines. It can be seen most clearly in FIG. 5 that, with the gusset bent downwardly and perpendicular to the plane of the first shelf 43, the gusset edges 71, 73 align closely with the upright face 75 of the panel 47 and the upright wall surface 42 on the upright. Consequently, downward bending of the shelf 43 is prohibited by the gusset bearing on the surface 42. At the same time, downward deflection of the second shelf 45 is arrested upon the offset surface 75 encountering the edge 71 of the gusset.

A desirable feature of the invention is that a rugged slider can be formed from a thin gauge material without welding or using fasteners. The formation of the slider involves simply stamping a blank and folding the blank in a prescribed manner.

The mounting tabs 53 are used to anchor the sliders to the uprights. Each mounting tab comprises an elongate body 77 having a leading edge or nose 79 and a trailing edge 81. The vertical wall 40 is extended beyond the ends 57, 59 of the blank to define a stem 83 which defines a T-shape with the body and spaces the tab body 77 from the ends 57, 59 of the rectangular blank body 51.

Figure 4:
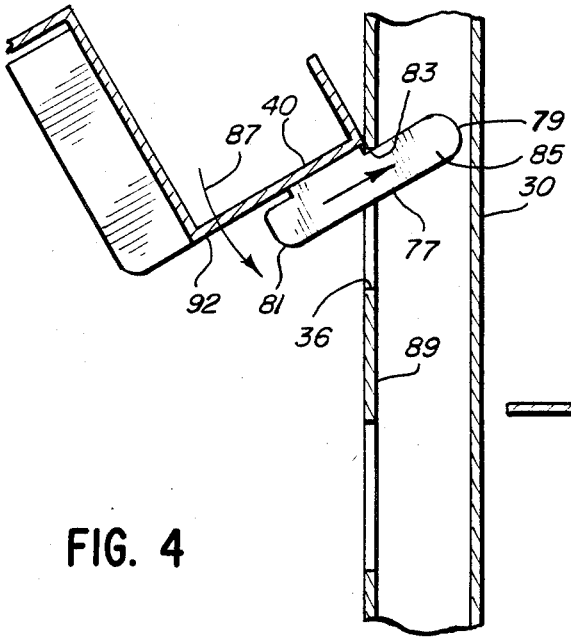
FIG. 4 is a fragmentary, sectional view of one of the sliders partially inserted into a mounting upright on the cart.

To assemble the slider, the slider is disposed at an angle with respect to the upright 30 as indicated in FIG. 4. The rounded nose 79 of each tab is introduced to a slot and extended until the upper edge 83 of the slot abuts the juncture of the stem and the leading portion 85 of the body 77. The entire slider is pivoted about the point of abutment in the direction of the arrow 87 in FIG. 4 to direct the trailing edge 81 of the body 77 behind the inside surface 89 of the upright, at which point the surface 92 of the face 40 facially abuts the wall 42 of the upright. The slider is locked by dropping the slider downwardly to its FIG. 5 position. In this position, the wall 95 of the upright is captured closely between the wall 92 of the wall 40 and the mounting tab body 77.

The slider is positively captured because the mounting tabs cannot be removed without tilting the slider away from the uprights. Because the weight of the loaded trays bears the sliders toward their locked position, the likelihood of inadvertently freeing the sliders is reduced.

The foregoing detailed description was made for purposes of demonstrating the structure and operation of the invention, with no unnecessary limitations to be understood therefrom.

We claim:

1. A one-piece, universal type sheet metal slider for a food service cart of the type having a cabinet with inside, facing walls to which a plurality of the sliders are mountable for slidably accepting food trays, said slider comprising:

a first, flat shelf for supporting an end of a tray having a first width, said first shelf having opposite ends;

a second shelf parallel to the first shelf for supporting an end of a tray having a second width less than said first width;

a panel portion connecting between said first and second shelves and substantially at right angles thereto;

a gusset integral with and folded perpendicularly to the plane of the first shelf in depending fashion at one end of said first shelf and having oppositely facing first and second edges, said first gusset edge being situated adjacent said panel and said second gusset edge being situated adjacent one of said facing walls so that said gusset simultaneously reinforces said one end of the first shelf and limits movement of said panel toward said one of the facing walls; and means for detachably mounting the slider to said one of the facing walls.

2. The universal-type slider of claim 1 wherein a wall portion extends at a right angle from said second shelf away from said first shelf, and at least one mounting tab is integral with and bent at right angles to the wall portion.

3. The universal-type slider of claim 1 wherein said slider is formed entirely from a sheet of stainless steel on the order of 16 gauge thickness.

4. The universal-type slider of claim 1 wherein a reinforcing shelf is formed integrally with the wall portion, makes a right angle therewith, and extends from the wall portion toward the first shelf.

5. The universal-type slider of claim 2 wherein each said facing wall has a pair of uprights with vertically spaced slots, and means are provided to removably and selectively situate the tab in the slots.

6. The universal-type slider of claim 1 wherein said means for detachable mounting the slider comprises a flat tap coplanar with said gusset.

7. A universal type sheet metal slider for a food service cart of the type having a cabinet with inside facing walls to which a plurality of the sliders are mountable for slidably accepting food trays, said slider being formed from a single sheet metal blank and comprising:

a first, flat shelf for supporting and end of a tray having a first width, said first shelf having opposite ends;

a flat, panel portion folded relative to the first shelf about a first fold line;

a second shelf parallel to the first shelf for supporting an end of a tray having a second width less than the first width and folded relative to the panel about a second fold line substantially parallel to the first fold line;

a gusset folded out of the plane of the first shelf in depending fashion and having oppositely facing first and second edges;

means for detachably mounting the slider to one of the facing walls, said first gusset edge being situated adjacent said panel and said second gusset edge being arranged to be disposed adjacent one of said facing walls as a result of the slider being installed thereon by said mounting means so that said gusset simultaneously reinforces said first and second shelves and said panel; and said slider being formable from the single metal blank without requirement for fasteners or welding.

* * * * *